US009025980B2

(12) United States Patent
Terasaki

(10) Patent No.: US 9,025,980 B2
(45) Date of Patent: May 5, 2015

(54) IMAGE FORMING APPARATUS, BIAS POWER SUPPLY DEVICE, AND BIAS POWER SUPPLY METHOD

(71) Applicant: Fuji Xerox Co., Ltd., Minato-ku, Tokyo (JP)

(72) Inventor: Masahiro Terasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 37 days.

(21) Appl. No.: 13/752,973

(22) Filed: Jan. 29, 2013

(65) Prior Publication Data

US 2014/0016956 A1 Jan. 16, 2014

(30) Foreign Application Priority Data

Jul. 10, 2012 (JP) ..... 2012-154519

(51) Int. Cl.
*G03G 15/16* (2006.01)

(52) U.S. Cl.
CPC ..... *G03G 15/1675* (2013.01)

(58) Field of Classification Search
USPC ..... 399/66, 28, 88; 307/75
See application file for complete search history.

(56) References Cited

U.S. PATENT DOCUMENTS

| | | | | |
|---|---|---|---|---|
| 7,558,501 | B2 * | 7/2009 | Saito et al. | 399/88 |
| 7,777,423 | B2 * | 8/2010 | Fischer et al. | 315/224 |
| 2004/0165901 | A1 * | 8/2004 | Nakata et al. | 399/66 |
| 2010/0329715 | A1 * | 12/2010 | Tsukamura et al. | 399/66 |
| 2011/0293314 | A1 * | 12/2011 | Saito et al. | 399/88 |

FOREIGN PATENT DOCUMENTS

| | | | |
|---|---|---|---|
| JP | 2000-232729 | A | 8/2000 |
| JP | 3721825 | B2 | 11/2005 |
| JP | 2010-161836 | A | 7/2010 |

* cited by examiner

*Primary Examiner* — Clayton E Laballe
*Assistant Examiner* — Trevor J Bervik
(74) *Attorney, Agent, or Firm* — Sughrue Mion, PLLC

(57) ABSTRACT

An image forming apparatus includes an image carrier, a charging unit, an exposure unit, a developing unit, and a transfer unit. The transfer unit includes a bias power supply and transfers a developed image onto a transfer body. The bias power supply includes a first power supply unit, a second power supply unit, a threshold setting unit, a detector, and an output controller. The first power supply unit generates a transfer electric field. The second power supply unit generates a non-transfer electric field. The threshold setting unit has a first threshold and a second threshold, and performs a change from the first threshold to the second threshold when switching from the non-transfer electric field to the transfer electric field is performed. The detector detects the current which is caused to flow by the first power supply unit. The output controller controls the first power supply unit.

14 Claims, 6 Drawing Sheets

IMAGE FORMING APPARATUS, BIAS POWER SUPPLY DEVICE, AND BIAS POWER SUPPLY METHOD

CROSS-REFERENCE TO RELATED APPLICATIONS

This application is based on and claims priority under 35 USC 119 from Japanese Patent Application No. 2012-154519 filed Jul. 10, 2012.

BACKGROUND

Technical Field

The present invention relates to an image forming apparatus, a bias power supply device, and a bias power supply method.

SUMMARY

According to an aspect of the invention, there is provided an image forming apparatus including an image carrier, a charging unit, an exposure unit, a developing unit, and a transfer unit. The charging unit charges the image carrier. The exposure unit exposes the image carrier charged by the charging unit to light and forms an electrostatic latent image on the image carrier. The developing unit develops the electrostatic latent image formed on the image carrier exposed by the exposure unit, so as to form a developed image. The transfer unit includes a bias power supply and transfers the developed image onto a transfer body. The bias power supply includes a first power supply unit, a second power supply unit, a threshold setting unit, a detector, and an output controller. The first power supply unit generates a transfer electric field for transferring the developed image onto the transfer body. The second power supply unit generates a non-transfer electric field having a polarity which is different from a polarity of the transfer electric field. The threshold setting unit has a first threshold and a second threshold. The first threshold corresponds to a first limit value for a current which is caused to flow by the first power supply unit. The second threshold corresponds to a second limit value which is larger than the first limit value in terms of an absolute value. The threshold setting unit performs a change from the first threshold to the second threshold when switching from the non-transfer electric field to the transfer electric field is performed. The detector detects the current which is caused to flow by the first power supply unit. The output controller controls the first power supply unit so that a voltage output from the first power supply unit decreases in terms of an absolute value, when the current which is caused to flow by the first power supply unit becomes larger than or equal to the first limit value or larger than or equal to the second limit value in accordance with the first threshold or the second threshold set by the threshold setting unit.

BRIEF DESCRIPTION OF THE DRAWINGS

An exemplary embodiment of the present invention will be described in detail based on the following figures, wherein.

DETAILED DESCRIPTION

Image Forming Apparatus 1

Figure 1:
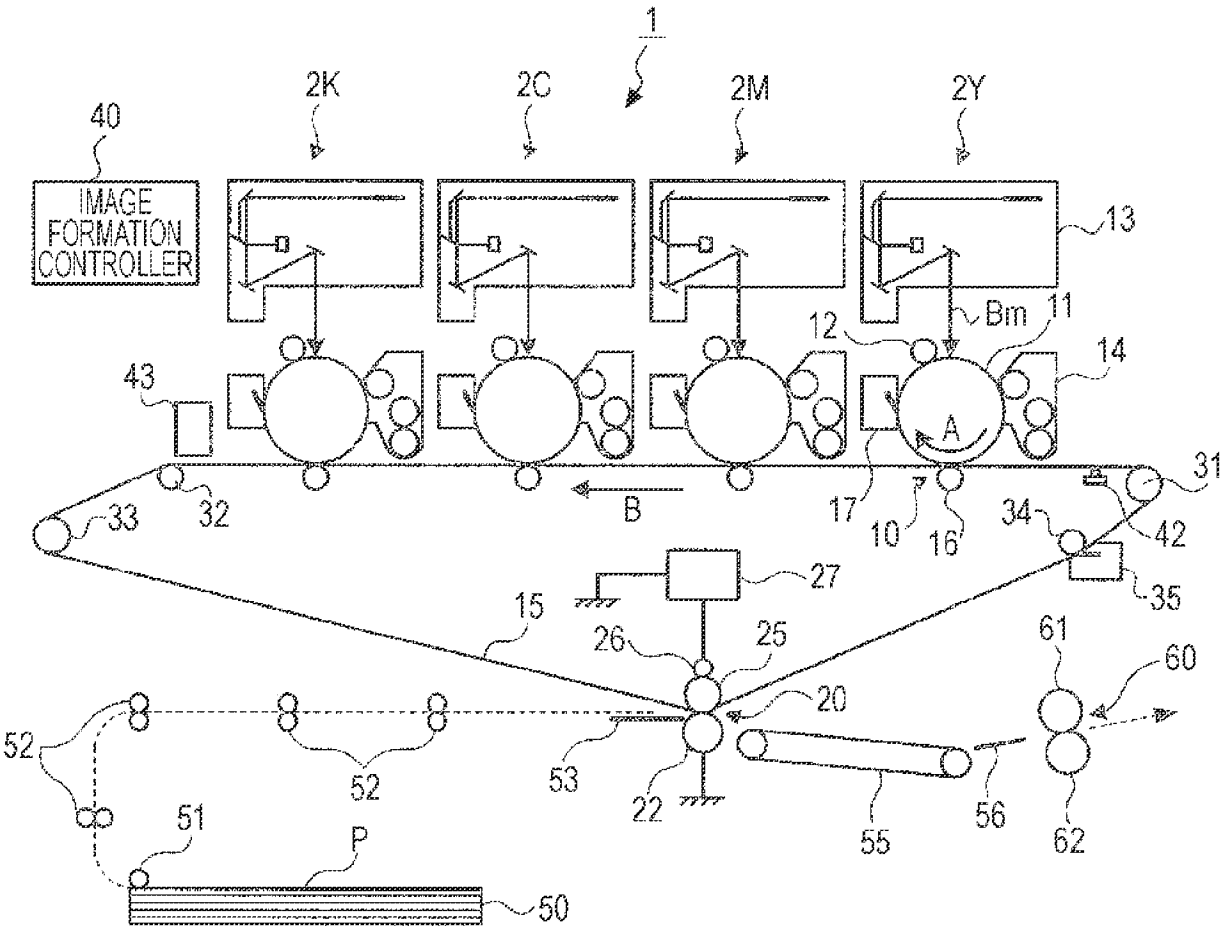
FIG. 1 is a schematic configuration diagram illustrating an example of an image forming apparatus according to an exemplary embodiment.

FIG. 1 is a schematic configuration diagram illustrating an example of an image forming apparatus 1 according to an exemplary embodiment. The image forming apparatus 1 illustrated in FIG. 1 is a tandem-type image forming apparatus which employs an intermediate transfer system, and includes plural image forming units 2Y, 2M, 2C, and 2K; first transfer sections 10; a second transfer section 20; and a fixing section 60. The image forming units 2Y, 2M, 2C, and 2K form toner images of respective color components by using an electrophotographic system. The first transfer sections 10 correspond to an example of transfer sections that sequentially transfer (first-transfer) the toner images of individual colors (color components) formed by the image forming units 2Y, 2M, 2C, and 2K onto an intermediate transfer belt 15. The second transfer section 20 is an example of a transfer section that simultaneously transfers (second-transfers) the toner images (superposed toner images of individual colors) which have been transferred onto the intermediate transfer belt 15 onto a sheet P, which is an example of a transfer body. The fixing section 60 fixes the second-transferred images onto the sheet P. Also, the image forming apparatus 1 includes an image formation controller 40 that controls the operations of individual devices (sections).

In the present exemplary embodiment, each of the image forming units 2Y, 2M, 2C, and 2K includes electrophotographic devices including a charging device 12, a laser exposure device 13, a developing device 14, a first transfer roller 16, and a drum cleaner 17, which are arranged around a photoconductor drum 11. The photoconductor drum 11 is an example of an image carrier that rotates in the direction indicated by an arrow A. The charging device 12 is an example of a charging unit that charges the photoconductor drum 11. The laser exposure device 13 is an example of an exposure unit that forms an electrostatic latent image on the photoconductor drum 11 (a light beam for exposure is denoted by a symbol Bm in FIG. 1). The developing device 14 is an example of a developing unit that contains toner of a corresponding color (component) and makes the electrostatic latent image on the photoconductor drum 11 visible by using the toner. The first transfer roller 16 transfers the toner image of the corresponding color formed on the photoconductor drum 11 onto the intermediate transfer belt 15 in the first transfer section 10. The drum cleaner 17 removes residual toner from the photoconductor drum 11. The image forming units 2Y, 2M, 2C, and 2K are arranged in the order of yellow (Y), magenta (M), cyan (C), and black (K) from the upstream side of the intermediate transfer belt 15.

The intermediate transfer belt 15, serving as an intermediate transfer body, is a film-like endless belt made of a resin, such as a polyimide resin or a polyamide resin, containing an appropriate amount of an antistatic agent such as carbon black. The volume resistivity of the intermediate transfer belt 15 is $10^6$ to $10^{14}$ Ωcm, and the thickness thereof is, for example, about 0.1 mm. The intermediate transfer belt 15 is rotated by various rollers in the direction indicated by an arrow B of FIG. 1 at a predetermined speed. The various rollers include a driving roller 31, a support roller 32, a tension roller 33, a backup roller 25, and a cleaning backup roller 34. The driving roller 31 is driven by a motor (not illustrated) having a constant speed characteristic and rotates the intermediate transfer belt 15. The support roller 32 supports the intermediate transfer belt 15, which extends linearly along the direction in which the photoconductor drums 11 are arranged. The tension roller 33 applies a tension to the intermediate transfer belt 15 and functions as a correction roller for preventing meander of the intermediate transfer belt 15. The backup roller 25 is provided in the second transfer section 20. The cleaning backup roller 34 removes residual toner from the intermediate transfer belt 15.

The first transfer section 10 includes the first transfer roller 16, which is disposed so as to face the photoconductor drum 11 with the intermediate transfer belt 15 therebetween. The first transfer roller 16 is constituted by a shaft and a sponge layer, which is an elastic layer fixed around the shaft. The shaft is a cylindrical bar made of metal, such as iron or steel use stainless (SUS). The sponge layer is a cylindrical sponge roller which is made of a blend of NBR rubber, SBR rubber, and EPDM rubber with a conductive agent, such as carbon black, and which has a volume resistivity of $10^7$ to $10^9$ Ωcm. The first transfer roller 16 is disposed so as to be pressed against the photoconductor drum 11 with the intermediate transfer belt 15 therebetween.

Furthermore, a voltage (first transfer bias) having a polarity opposite to the polarity of the charge of the toner (for example, negative polarity) is applied to the first transfer roller 16. Accordingly, toner images on the individual photoconductor drums 11 are sequentially and electrostatically attracted to the intermediate transfer belt 15, and thereby multilayer toner images (toner images 101*a* and 101*b* illustrated in FIG. 2 described below) are formed on the intermediate transfer belt 15.

The second transfer section 20 includes the second transfer roller 22, which is disposed so as to face the backup roller 25 with the intermediate transfer belt 15 therebetween. The second transfer roller 22 is disposed on a toner image carrying surface side of the intermediate transfer belt 15, and is grounded (ground voltage GND). A power feed roller 26 made of metal is disposed in contact with the backup roller 25. The power feed roller 26 is connected to a transfer bias power supply 27, which is an example of a bias power supply device for supplying a second transfer bias.

The transfer bias power supply 27 generates a second transfer bias, and stably applies the generated second transfer bias to the backup roller 25 via the power feed roller 26.

The backup roller 25 has a tubular surface made of a blend of EPDM rubber and NBR rubber dispersed with carbon, and an inner portion made of EPDM rubber. The surface resistivity of the backup roller 25 is $10^7$ to $10^{10}$ Ω/square, and the hardness thereof is set to be, for example, about 70 degrees (Asker C).

The second transfer roller 22 includes a shaft and a sponge layer, which is an elastic layer fixed around the shaft. The shaft is a cylindrical bar made of metal, such as iron or SUS. The sponge layer is a cylindrical sponge roller which is made of a blend of NBR rubber, SBR rubber, and EPDM rubber with a conductive agent, such as carbon black, and which has a volume resistivity of $10^7$ to $10^9$ Ωcm. The second transfer roller 22 is disposed so as to be pressed against the backup roller 25 with the intermediate transfer belt 15 therebetween, so as to form a transfer nip region.

The second transfer roller 22 is grounded (ground voltage GND) to generate a second transfer bias between the second transfer roller 22 and the backup roller 25, and second-transfers a toner image onto the sheet P transported to the second transfer section 20.

An intermediate transfer belt cleaner 35 is disposed on the downstream side of the second transfer section 20 along the intermediate transfer belt 15 so as to be contactable with the intermediate transfer belt 15. The intermediate transfer belt cleaner 35 cleans the surface of the intermediate transfer belt 15 by removing residual toner and paper dust from the intermediate transfer belt 15 after a second transfer process ends. A reference sensor (home position sensor) 42 is disposed on the upstream side of the image forming unit 2Y for yellow. The reference sensor 42 generates a reference signal, which is a reference for adjusting image formation timings of the image forming units 2Y, 2M, 2C, and 2K. An image density sensor 43 for adjusting image quality is disposed on the downstream side of the image forming unit 2K for black.

The reference sensor 42 generates a reference signal by identifying a predetermined mark provided on the back side of the intermediate transfer belt 15. The image formation controller 40 issues an instruction in accordance with the reference signal, and each of the image forming units 2Y, 2M, 2C, and 2K starts image formation in response to the instruction.

The image density sensor 43 detects test toner images for controlling density (test toner images 102*a* and 102*b* illustrated in FIG. 2 described below). In accordance with a detection result about the test toner images detected by the image density sensor 43, the operation conditions of the image forming units 2Y, 2M, 2C, and 2K are adjusted, and the density of toner images to be formed is adjusted.

Furthermore, the image forming apparatus 1 according to the present exemplary embodiment includes a sheet container 50, a pick-up roller 51, transport rollers 52, a sheet transport path 53, a transport belt 55, and an entrance guide 56, which constitute a sheet transport system. The sheet container 50 contains the sheet P. The pick-up roller 51 picks up the sheet P from the sheet container 50 at a predetermined timing and feeds the sheet P. The transport rollers 52 transport the sheet P fed by the pick-up roller 51. The sheet transport path 53 guides the sheet P which has been transported by the transport rollers 52 to the second transfer section 20. The transport belt 55 transports, to the fixing section 60, the sheet P on which a second transfer process has been performed by the second transfer roller 22. The entrance guide 56 guides the sheet P to the fixing section 60.

The fixing section 60 includes a heating roller 61 which has a heat source such as a halogen lamp, and a pressure roller 62 which is pressed against the heating roller 61. The sheet P onto which a toner image has been transferred is caused to pass through a fixing nip region, which is formed between the heating roller 61 and the pressure roller 62, so that the toner image is fixed onto the sheet P.

Next, a basic image formation process of the image forming apparatus 1 according to the present exemplary embodiment will be described. In the image forming apparatus 1 illustrated in FIG. 1, image data which is output from an image reading apparatus, a personal computer (PC), or the like (not illustrated) undergoes predetermined image processing performed by an image processing apparatus (not illustrated), and then undergoes an image formation operation performed by the image forming units 2Y, 2M, 2C, and 2K. The image processing apparatus performs predetermined image processing, including various image edit operations, such as shading correction using reflectivity data that is input, displacement correction, brightness/color space conversion, gamma correction, frame erasing, color adjustment, and movement. The processed image data is converted to color gradation data for four colors, Y, M, C, and K, and the color gradation data is output to the laser exposure devices 13.

In accordance with the input color gradation data, the laser exposure devices 13 irradiate the photoconductor drums 11 of the image forming units 2Y, 2M, 2C, 2K with light beams Bm emitted by, for example, semiconductor lasers. The surfaces of the photoconductor drums 11 of the image forming units 2Y, 2M, 2C, and 2K are charged by the charging devices 12, and are then scanned and exposed by the laser exposure devices 13, so that electrostatic latent images are formed on the surfaces. The formed electrostatic latent images are developed to toner images of Y, M, C, and K by the developing devices 14 of the image forming units 2Y, 2M, 2C, and 2K.

The toner images of the individual colors which have been formed on the photoconductor drums 11 of the image forming units 2Y, 2M, 2C, and 2K are transferred onto the intermediate transfer belt 15 in the first transfer sections 10, in which the individual photoconductor drums 11 come into contact with the intermediate transfer belt 15. More specifically, in the first transfer sections 10, the first transfer rollers 16 each apply a voltage (first transfer bias) having a polarity (positive polarity) opposite to the polarity of the charge of the toner to a base of the intermediate transfer belt 15, and the toner images are sequentially transferred onto the surface of the intermediate transfer belt 15. In this way, a first transfer process is performed.

After the toner images have been sequentially transferred onto the surface of the intermediate transfer belt 15, the intermediate transfer belt 15 is rotated so that the toner images are transported to the second transfer section 20. In synchronization with the timing at which the toner images are transported to the second transfer section 20, the pick-up roller 51 in the sheet transport system starts rotating, and the sheet P having a predetermined size is fed from the sheet container 50. The sheet P fed by the pick-up roller 51 is transported by the transport rollers 52, and reaches the second transfer section 20 via the sheet transport path 53. Before reaching the second transfer section 20, the sheet P is temporarily stopped. A registration roller (not illustrated) rotates in synchronization with a rotation timing of the intermediate transfer belt 15 which carries the toner images, and thereby the position of the sheet P and the position of the toner images are adjusted.

In the second transfer section 20, the second transfer roller 22 is pressed against the backup roller 25 with the intermediate transfer belt 15 therebetween. At this time, the sheet P which has been transported at an appropriate timing is nipped between the intermediate transfer belt 15 and the second transfer roller 22. Then, a voltage (transfer electric field of a negative voltage as an example of a first voltage (second transfer bias)) having a polarity (negative polarity) that is the same as the polarity of the charge of the toner is applied from the transfer bias power supply 27 to the backup roller 25 via the power feed roller 26. Accordingly, a transfer electric field is generated between the second transfer roller 22 and the backup roller 25. Then, the unfixed toner images carried on the intermediate transfer belt 15 are simultaneously and electrostatically transferred onto the sheet P in the second transfer section 20, where the toner images are pressed by the second transfer roller 22 and the backup roller 25.

Though details will be described below, test toner images carried on the intermediate transfer belt 15 are not electrostatically transferred onto the sheet P. Thus, when the test toner images pass through the second transfer section 20, the transfer bias power supply 27 supplies, to the backup roller 25 via the power feed roller 26, a voltage (non-transfer electric field of a positive voltage as an example of a second voltage (cleaning bias)) having a polarity (positive polarity) opposite to the polarity of the charge of the toner. This suppresses the adhesion of the toner forming the test toner images to the second transfer roller 22, and causes the toner on the second transfer roller 22 to adhere to the intermediate transfer belt 15, thereby cleaning the second transfer roller 22.

That is, the transfer bias power supply 27 supplies a positive-polarity voltage (positive voltage) and a negative-polarity voltage (negative voltage) by switching therebetween.

Here, the transfer bias power supply 27 supplies, in the second transfer section 20, an output voltage Vout to the backup roller 25, the intermediate transfer belt 15, and the second transfer roller 22 connected to the ground (ground voltage GND) via the power feed roller 26. Then, the sheet P is nipped between the intermediate transfer belt 15 and the second transfer roller 22. Accordingly, the backup roller 25, the intermediate transfer belt 15, and the second transfer roller 22 connected to the ground (ground voltage GND) become the load of the transfer bias power supply 27 via the power feed roller 26. At this time, if the sheet P is between the intermediate transfer belt 15 and the second transfer roller 22, the sheet P is also included in the load.

Here, a current which flows through the load due to the output voltage Vout is referred to as an output current Iout.

After that, the sheet P onto which the toner images have been electrostatically transferred is peeled off the intermediate transfer belt 15 by the second transfer roller 22 and is transported to the transport belt 55, which is disposed on the downstream side of the second transfer roller 22 in the sheet transport direction. The transport belt 55 transports the sheet P to the fixing section 60 at an optimum transport speed, in accordance with the transport speed in the fixing section 60. The unfixed toner images on the sheet P which has been transported to the fixing section 60 undergo a fixing process, which is performed by the fixing section 60 with heat and pressure, and thereby being fixed onto the sheet P. Then, the sheet P having a fixed image thereon is transported to an output sheet stacker (not illustrated) provided in an output section of the image forming apparatus 1.

After the toner images have been transferred onto the sheet P, residual toner on the intermediate transfer belt 15 (including the test toner images) is transported in accordance with the rotation of the intermediate transfer belt 15, and is removed from the intermediate transfer belt 15 by the cleaning backup roller 34 and the intermediate transfer belt cleaner 35. Toner images 101*a* and 101*b*, and test toner images 102*a* and 102*b*

Figure 2:
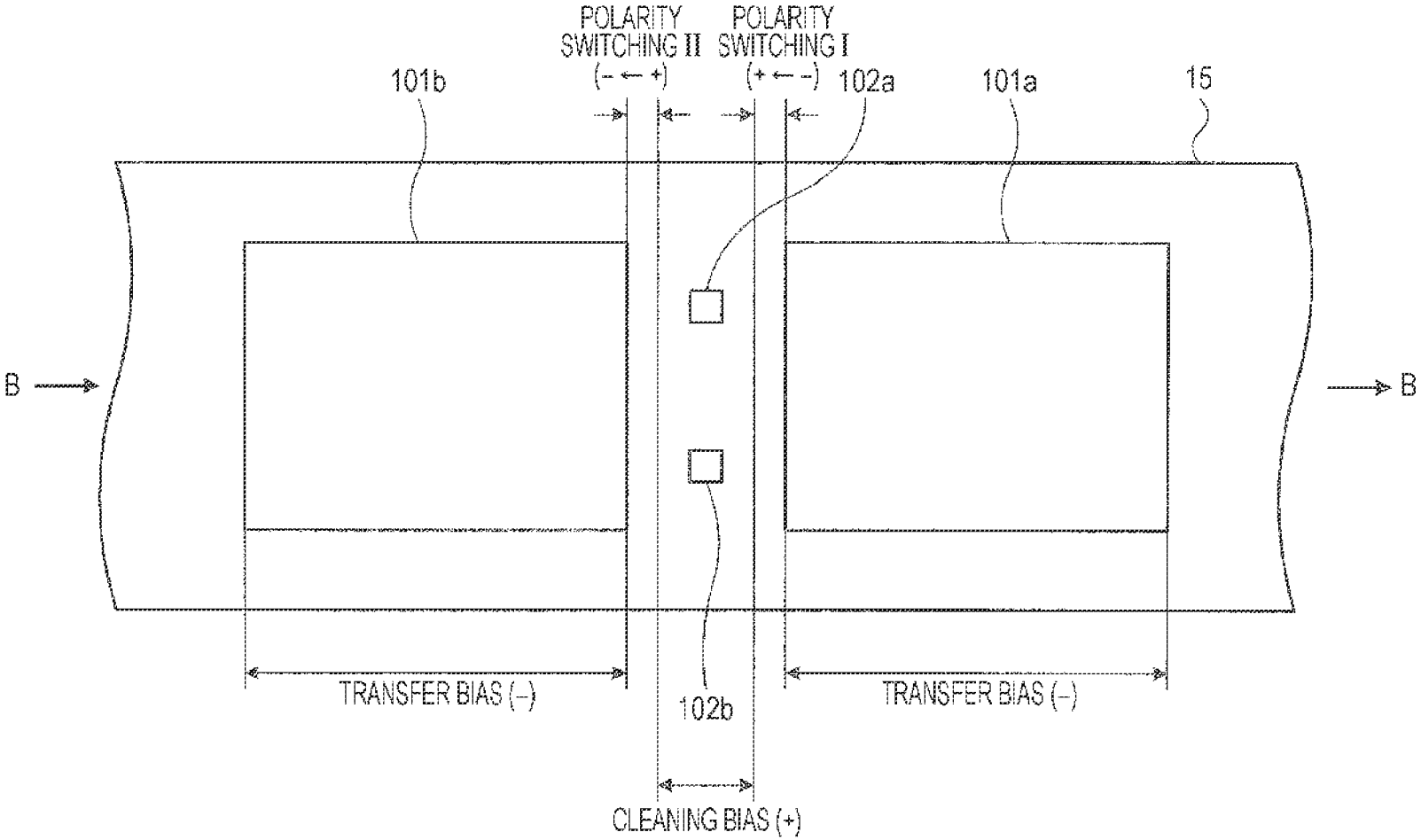
FIG. 2 is a diagram illustrating toner images and test toner images on an intermediate transfer belt.

FIG. 2 is a diagram illustrating the toner images 101*a* and 101*b* and the test toner images 102*a* and 102*b* on the intermediate transfer belt 15. FIG. 2 illustrates a part of the intermediate transfer belt 15 viewed from the second transfer roller 22 side in the second transfer section 20 illustrated in FIG. 1. The intermediate transfer belt 15 rotates in the direction indicated by the arrow B.

Hereinafter, a second transfer bias is referred to as a transfer bias.

As illustrated in FIG. 2, in the first transfer sections 10 in the image forming units 2Y, 2M, 2C, and 2K, toner images of the individual colors formed on the individual photoconductor drums 11 are superposed on the intermediate transfer belt 15, and thereby the toner image 101*a* is formed. Subsequently, like the toner image 101*a*, in the first transfer sections 10 in the image forming units 2Y, 2M, 2C, and 2K, test toner images of the individual colors formed on the individual photoconductor drums 11 are superposed on the intermediate transfer belt 15, and thereby the test toner images 102*a* and 102*b* are formed. Subsequently, in the first transfer sections 10 in the image forming units 2Y, 2M, 2C, and 2K, toner images of the individual colors formed on the individual photoconductor drums 11 are superposed on the intermediate transfer belt 15, and thereby the toner image 101*b* is formed. Here, each of the toner images 101*a* and 101*b* is referred to as a toner image 101 when they are not distinguished from each other, and each of the test toner images 102*a* and 102*b* is referred to as a test toner image 102 when they are not distinguished from each other.

The image forming apparatus 1 according to the present exemplary embodiment alternately and repeatedly forms toner images 101 and test toner images 102 on the intermediate transfer belt 15. Also, the image forming apparatus 1 forms the two test toner images 102*a* and 102*b* in parallel along the direction orthogonal to the rotation direction of the intermediate transfer belt 15 (the direction indicated by the arrow B).

Alternatively, the two test toner images 102*a* and 102*b* may be formed so as to be displaced along the rotation direction of the intermediate transfer belt 15. Alternatively, one test toner image 102 may be formed.

The test toner images 102 are used for adjusting the density of toner images to be formed in the image forming units 2Y, 2M, 2C, and 2K in accordance with a detection result generated by the image density sensor 43. Thus, the test toner image may be a test image composed of plural regions, such as a toner image which is independently formed by each of the image forming units 2Y, 2M, 2C, and 2K, or a multilayer toner image formed by some of the image forming units 2Y, 2M, 2C, and 2K.

The test toner images 102 are not necessarily provided. Without toner images 101 and test toner images 102 being alternately formed, plural toner images 101 may be successively formed and then a test toner image 102 may be formed.

A registration roller (not illustrated) rotates in synchronization with a rotation timing of the intermediate transfer belt 15, and thereby the position of the sheet P and the position of the toner image 101 are adjusted. Then, the toner image 101 is transferred onto the sheet P which has been transported. Thus, for the toner image 101, the transfer bias power supply 27 supplies a transfer bias of a negative voltage to the backup roller 25 via the power feed roller 26, so that the toner image 101 is transferred onto the sheep P.

In contrast, for the test toner image 102, the transfer bias power supply 27 supplies a cleaning bias of a positive voltage to the backup roller 25 via the power feed roller 26. This suppresses the adhesion of the test toner image 102 on the intermediate transfer belt 15 to the second transfer roller 22, and causes the toner on the second transfer roller 22 to adhere to the intermediate transfer belt 15, thereby cleaning the second transfer roller 22.

Thus, even in a case where no test toner images are formed, the transfer bias power supply 27 may supply a cleaning bias of a positive voltage to the backup roller 25 to clean the second transfer roller 22 at the interval between the toner images 101. The description given below is based on the assumption that the transfer bias power supply 27 supplies a cleaning bias of a positive voltage to the backup roller 25 at the interval between the toner images 101, regardless of whether or not the test toner image 102 exists.

In a case where the charge polarity of toner is positive, the transfer bias power supply 27 supplies a transfer bias of a positive voltage to the backup roller 25 via the power feed roller 26 for the toner image 101, and supplies a cleaning bias of a negative voltage to the backup roller 25 via the power feed roller 26 for the test toner image 102.

As illustrated in FIG. 2, the transfer bias power supply 27 switches the output voltage (output voltage Vout in FIG. 3) from a transfer bias of a negative voltage to a cleaning bias of a positive voltage between the toner image 101*a* and the test toner images 102*a* and 102*b* (polarity switching I). Also, the transfer bias power supply 27 switches the output voltage from a cleaning bias of a positive voltage to a transfer bias of a negative voltage between the test toner images 102*a* and 102*b* and the toner image 101*b* (polarity switching II).

Note that it is necessary to apply a transfer bias of a negative voltage while the sheet P exists in the second transfer section 20, in order to transfer the toner image 101 onto the sheet P. After the sheet P has passed through the second transfer section 20, a cleaning bias of a positive voltage may be applied so that the toner does not adhere to the second transfer roller 22. Therefore, in FIG. 2, the period over which a cleaning bias of a positive voltage is applied is set so as to include periods before and after the test toner images 102.

To increase the operation speed of the image forming apparatus 1, it is demanded to shorten the time period in which the polarity of the output voltage is switched in polarity switching I and polarity switching II.

With an increase in the operation speed of the image forming apparatus 1, the absolute values of a transfer bias of a negative voltage and a cleaning bias of a positive voltage increase, and also the magnitude of a rush current generated in polarity switching increases. In a second transfer process, a transfer bias is 12 kV, and a cleaning bias is 1 kV, for example. Thus, the magnitude of a rush current is large at the switching from a cleaning bias of a positive voltage to a transfer bias of a negative voltage, compared to the opposite.

Circuit Blocks of Transfer Bias Power Supply 27

Figure 3:
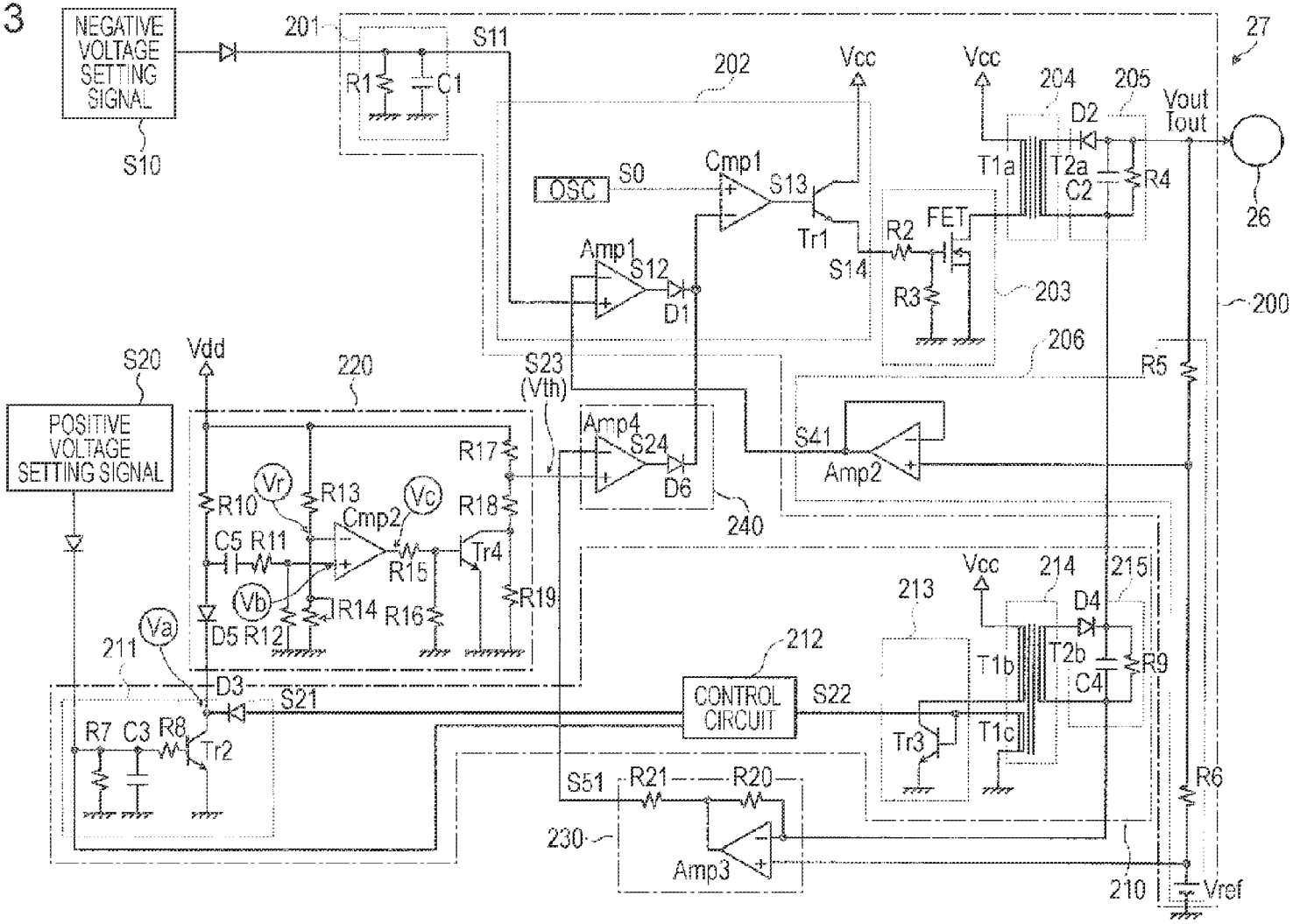
FIG. 3 is a diagram illustrating an example of circuit blocks and a circuit configuration of a transfer bias power supply according to the exemplary embodiment.

FIG. 3 is a diagram illustrating an example of circuit blocks and a circuit configuration of the transfer bias power supply 27 according to the present exemplary embodiment. In FIG. 3, each circuit block is surrounded by a broken line or a chain line.

First, the circuit blocks of the transfer bias power supply 27 will be described.

The transfer bias power supply 27 includes a negative voltage generating unit 200, a positive voltage generating unit 210, a threshold setting circuit 220, a current detecting circuit 230, and an output control circuit 240. The negative voltage generating unit 200 is an example of a first power supply unit that generates a transfer bias of a negative voltage. The positive voltage generating unit 210 is an example of a second power supply unit that generates a cleaning bias of a positive voltage. The threshold setting circuit 220 is an example of a threshold setting unit that sets a threshold voltage Vth corresponding to a limit current Ip in the case of supplying a transfer bias of a negative voltage. The current detecting circuit 230 is an example of a detector that detects a current which flows via the power feed roller 26. The output control circuit 240 is an example of an output controller that reduces the absolute value of a transfer bias of a negative voltage supplied from the negative voltage generating unit 200 if the current detected by the current detecting circuit 230 exceeds the limit current Ip that is set in accordance with the threshold voltage Vth.

The negative voltage generating unit 200 includes an analog conversion circuit 201, a control circuit 202, a driving circuit 203, a transformer 204, a rectifier circuit 205, and a voltage detecting circuit 206.

The positive voltage generating unit 210 includes a positive voltage on/off circuit 211, a control circuit 212, a driving circuit 213, a transformer 214, and a rectifier circuit 215.

As illustrated in FIG. 3, the rectifier circuit 205 of the negative voltage generating unit 200 and the rectifier circuit 215 of the positive voltage generating unit 210 are connected in series. Accordingly, a transfer bias of a negative voltage generated by the negative voltage generating unit 200 and a cleaning bias of a positive voltage generated by the positive voltage generating unit 210 are switched between and supplied to the power feed roller 26.

In the present exemplary embodiment, the transfer bias power supply 27 receives a negative voltage setting signal S10 and a positive voltage setting signal S20 from the image formation controller 40 via diodes (without reference numerals). The negative voltage setting signal S10 sets the value of a transfer bias of a negative voltage generated by the negative voltage generating unit 200. The positive voltage setting signal S20 sets the value of a cleaning bias of a positive voltage generated by the positive voltage generating unit 210.

The negative voltage setting signal S10 comes into a state of a pulse width modulated signal (PWM signal) which has an amplitude between a high level (hereinafter "H") and a low level (hereinafter "L") when the transfer bias power supply 27 supplies a negative voltage, and comes into a "L" state when the transfer bias power supply 27 supplies a positive voltage.

On the other hand, the positive voltage setting signal S20 comes into a state of a PWM signal which has an amplitude between "L" and "H" when the transfer bias power supply 27 supplies a positive voltage, and comes into a "L" state when the transfer bias power supply 27 supplies a negative voltage.

For example, "H" is 3 V, and "L" is 0 V.

The value of a transfer bias of a negative voltage is set in accordance with the duty ratio of the PWM signal in the positive voltage setting signal S10. Likewise, the value of a cleaning bias of a positive voltage is set in accordance with the duty ratio of the PWM signal in the positive voltage setting signal S20.

Circuit Configuration of Transfer Bias Power Supply 27

Next, the circuit configuration of the transfer bias power supply 27 will be described.

Negative Voltage Generating Unit 200

First, the negative voltage generating unit 200 will be described. The negative voltage generating unit 200 is a separately excited switching power supply.

Analog Conversion Circuit 201

When the negative voltage setting signal S10 received from the image formation controller 40 is in the state of a PWM signal, the analog conversion circuit 201 smoothes the PWM signal to convert it to a DC voltage (analog voltage), and outputs an analog signal S11.

The analog conversion circuit 201 includes a resistor R1 and a capacitor C1. The resistor R1 and the capacitor C1 are connected in parallel. One terminals of the resistor R1 and the capacitor C1 serve as an input terminal and an output terminal of the analog conversion circuit 201. The other terminals of the resistor R1 and the capacitor C1 are grounded (ground voltage GND). The ground voltage GND is 0 V.

When the negative voltage setting signal S10 is in the state of a PWM signal, the analog conversion circuit 201 smoothes the PWM signal with the capacitor C1 storing charge, and converts the signal to the analog signal S11 of a DC voltage (analog signal). At this time, the voltage value of the analog signal S11 is set in accordance with the duty ratio of the PWM signal of the negative voltage setting signal S10. That is, as the duty ratio of the PWM signal of the negative voltage setting signal S10 increases, the amount of charge stored in the capacitor C1 increases and the voltage of the analog signal S11 increases. In contrast, as the duty ratio of the PWM signal of the negative voltage setting signal S10 decreases, the amount of charge stored in the capacitor C1 decreases and the voltage of the analog signal S11 decreases.

The resistor R1 sets time constants for charging and discharging of the capacitor C1.

When the negative voltage setting signal S10 is in the "L" state (0 V), the resistor R1 causes the capacitor C1 to discharge, and the voltage of the analog signal S11 becomes the ground voltage GND (0 V).

If the negative voltage setting signal S10 is an analog signal, not a PWM signal, the analog signal may be affected by noise or the like while being transmitted from the image formation controller 40 to the transfer bias power supply 27, and the voltage of the analog signal may be changed. For this reason, the negative voltage setting signal S10 is a PWM signal, so that an influence of noise is suppressed.

When it is not necessary to suppress an influence of noise, the negative voltage setting signal S10 may be an analog signal, and the analog conversion circuit 201 may be omitted.

The same applies to the positive voltage setting signal S20, which will be described below.

Control Circuit 202

The control circuit 202 performs feedback control to reduce the difference between a negative voltage that is actually generated by the negative voltage generating unit 200 and a value set by the analog signal S11. The negative voltage generating unit 200 is a separately excited switching power supply, and includes an oscillator OSC in the control circuit 202.

Here, the oscillator OSC oscillates a triangular-wave signal S0. Alternatively, the oscillator OSC may oscillate a signal capable of generating a PWM signal, such as a saw-tooth-wave signal.

The control circuit 202 includes the oscillator OSC that oscillates the triangular-wave signal S0, a comparator Cmp1, an error amplifier Amp1, an npn transistor Tr1, and a diode D1.

The oscillator OSC is connected to a non-inversion input terminal (hereinafter referred to as a positive input terminal) of the comparator Cmp1, and supplies the triangular-wave signal S0 thereto.

An inversion input terminal (hereinafter referred to as a negative input terminal) of the comparator Cmp1 is connected to an output terminal of the error amplifier Amp1 via the diode D1. Also, the negative input terminal of the comparator Cmp1 is connected to the output control circuit 240.

An output terminal of the comparator Cmp1 is connected to a base terminal of the npn transistor Tr1.

An emitter terminal of the npn transistor Tr1 is connected to the driving circuit 203. A collector terminal of the npn transistor Tr1 is connected to a power supply voltage Vcc (for example, 24 V).

Although not illustrated, a power supply voltage Vdd (for example, 5 V) is supplied to the comparator Cmp1 and the error amplifier Amp1.

A positive input terminal of the error amplifier Amp1 is connected to the analog conversion circuit 201, and receives the analog signal S11. A negative input terminal of the error amplifier Amp1 is connected to the voltage detecting circuit 206, and receives a detection signal S41 which is proportional to the output voltage Vout detected by the voltage detecting circuit 206, which will be described below.

The error amplifier Amp1 compares the analog signal S11 with the detection signal S41, amplifies the difference therebetween, and outputs an output signal S12.

The positive input terminal of the comparator Cmp1 receives the triangular-wave signal S0 oscillated by the oscillator OSC.

The diode D1 is provided between the error amplifier Amp1 and the negative input terminal of the comparator Cmp1, and a diode D6 is provided between an error amplifier Amp4 of the output control circuit 240 and the negative input terminal of the comparator Cmp1. Cathode terminals of the diodes D1 and D6 are connected to the negative input terminal of the comparator Cmp1.

Accordingly, the negative input terminal of the comparator Cmp1 selects and receives a signal having a higher voltage among the output signal S12 of the error amplifier Amp1 and an output signal S24 of the output control circuit 240.

The output signal S24 of the output control circuit 240 is a signal that is output by the error amplifier Amp4 in the output control circuit 240, which will be described below.

In the following description, voltage drop caused by the diodes D1 and D6 is not considered.

The comparator Cmp1 compares the triangular-wave signal S0 received by the positive input terminal with the signal received by the negative input terminal. If the magnitude of the triangular-wave signal S0 is larger than that of the signal received by the negative input terminal, the comparator Cmp1 outputs a pulse-width-modulated output signal S13 having the power supply voltage Vdd. If the magnitude of the triangular-wave signal S0 is smaller than that of the signal received by the negative input terminal, the comparator Cmp1 outputs a pulse-width-modulated output signal S13 having the ground voltage GND.

With the output signal S13, the npn transistor Tr1 is turned on/off, whereby the control circuit 202 outputs a pulse-width-modulated output signal S14 having an amplitude between the power supply voltage Vcc and the ground voltage GND.

Driving Circuit 203

The driving circuit 203 receives the output signal S14 from the control circuit 202, performs switching (on/off) of a field-effect transistor FET, which is a switching element, and thereby controls a current which flows through a primary winding T1*a* of the transformer 204, which will be described below.

The driving circuit 203 includes resistors R2 and R3 and the field-effect transistor FET.

One terminal of the resistor R2 is connected to the emitter terminal of the npn transistor Tr1 of the control circuit 202. The other terminal of the resistor R2 is connected to one terminal of the resistor R3 and is also connected to a gate terminal of the field-effect transistor FET. The other terminal of the resistor R3 is grounded (ground voltage GND).

A source terminal of the field-effect transistor FET is grounded (ground voltage GND). A drain terminal of the field-effect transistor FET is connected to the transformer 204.

When the npn transistor Tr1 of the control circuit 202 is turned on, the voltage at the gate terminal of the field-effect transistor FET becomes the power supply voltage Vcc via the npn transistor Tr1 and the resistor R2, and thereby the field-effect transistor FET is turned on. When the npn transistor Tr1 of the control circuit 202 is turned off, the voltage at the gate terminal of the field-effect transistor FET becomes the ground voltage GND via the resistor R3, and thereby the field-effect transistor FET is turned off.

That is, the field-effect transistor FET of the driving circuit 203 is switched (on/off) in accordance with on/off of the npn transistor Tr1 of the control circuit 202.

Transformer 204

The transformer 204 includes the primary winding T1*a* and a secondary winding T2*a*. A current which flows through the primary winding T1*a* induces a current which flows through the secondary winding T2*a*.

The power supply voltage Vcc is supplied to one terminal of the primary winding T1*a*. The other terminal of the primary winding T1*a* is connected to the drain terminal of the field-effect transistor FET of the driving circuit 203.

The secondary winding T2*a* is connected to the rectifier circuit 205.

When the field-effect transistor FET of the driving circuit 203 is turned on, a current flows between the power supply voltage Vcc and the ground voltage GND via the primary winding T1*a* and the field-effect transistor FET. A current which flows through the primary winding T1*a* induces a current which flows through the secondary winding T2*a*, and a voltage corresponding to the winding ratio of the primary winding T1*a* to the secondary winding T2*a* is induced at the secondary winding T2*a*.

Rectifier Circuit 205

The rectifier circuit 205 rectifies a current induced at the secondary winding T2*a* of the transformer 204, and generates a transfer bias of a negative voltage.

The rectifier circuit 205 includes a diode D2, a capacitor C2, and a resistor R4.

A cathode terminal of the diode D2 is connected to one terminal of the secondary winding T2*a*. An anode terminal of the diode D2 is connected to one terminals of the capacitor C2 and the resistor R4 which are connected in parallel, and is also connected to the power feed roller 26. The other terminals of the capacitor C2 and the resistor R4 which are connected in parallel are connected to the other terminal of the secondary winding T2*a*.

In the current induced at the secondary winding T2*a* of the transformer 204, a current which flows through the diode D2 causes the capacitor C2 to be charged, and thereby a transfer bias of a negative voltage is generated.

Voltage Detecting Circuit 206

The voltage detecting circuit 206 detects the output voltage Vout, and outputs the detection signal S41 which is proportional to the output voltage Vout.

The voltage detecting circuit 206 includes an error amplifier Amp2 and resistors R5 and R6. The resistors R5 and R6 are connected in series. The terminal of the resistor R5 which is not connected to the resistor R6 is connected to the power feed roller 26. The terminal of the resistor R6 which is not connected to the resistor R5 is grounded (ground voltage GND) via a reference voltage Vref (for example, 5 V).

A positive terminal of the error amplifier Amp2 is connected to a connection point between the resistors R5 and R6, and a negative terminal is connected to an output terminal of the error amplifier Amp2. The output terminal of the error amplifier Amp2 is connected to the negative input terminal of the error amplifier Amp1 of the control circuit 202.

The error amplifier Amp2 detects a voltage generated by dividing, with the resistors R5 and R6, the output voltage Vout, and outputs the detection signal S41 whose voltage is proportional to the output voltage Vout.

The reference voltage Vref suppresses that the voltage at the positive input terminals of the error amplifier Amp2 and an error amplifier Amp3 of the current detecting circuit 230 (described below) become a negative voltage.

Positive Voltage Generating Unit 210

Next, the positive voltage generating unit 210 will be described. The positive voltage generating unit 210 is a self-excited switching power supply.

Positive Voltage On/Off Circuit 211

The positive voltage on/off circuit 211 outputs a positive voltage on/off signal S21 which corresponds to the PWM signal state or the "L" state of the positive voltage setting signal S20 received from the image formation controller 40.

The positive voltage on/off circuit 211 includes resistors R7 and R8, a capacitor C3, and an npn transistor Tr2. The resistor R7 and the capacitor C3 are connected in parallel. One terminals of the resistor R7 and the capacitor C3 serve as input terminals and are connected to a base terminal of the npn transistor Tr2 via the resistor R8. The other terminals of the resistor R7 and the capacitor C3 are grounded (ground voltage GND).

A collector terminal of the npn transistor Tr2 is connected to the control circuit 212 via the diode D3, and is also connected to the threshold setting circuit 220, which will be described below.

An emitter terminal of the npn transistor Tr2 is grounded (ground voltage GND).

In the positive voltage on/off circuit 211, when the positive voltage setting signal S20 is in the "L" state (0 V), the voltage is 0 V at the base terminal of the npn transistor Tr2, and the npn transistor Tr2 is in an off-state. Thus, the voltage at the collector terminal is the power supply voltage Vdd (5 V) via a resistor R10 and a diode D5 of the threshold setting circuit 220, which will be described below. Accordingly, the positive voltage on/off signal S21 becomes the power supply voltage Vdd (5 V). Here, an influence of voltage drop caused by the diode D3 is not considered. The voltage at the collector terminal is regarded as a voltage Va.

When the positive voltage setting signal S20 is in the PWM signal state, the capacitor C3 stores charge to smooth the PWM signal. When the voltage increases at one terminal of the capacitor C3, the npn transistor Tr2 is turned on. Accordingly, the voltage at the collector terminal (voltage Va) of the npn transistor Tr2 changes from the power supply voltage Vdd (5 V) to the ground voltage GND (0 V). Accordingly, the positive voltage on/off signal S21 becomes the ground voltage GND (0 V).

The resistor R8 is a current limiting resistor that limits the current which flows trough the base terminal of the npn transistor Tr2.

Control Circuit 212

The control circuit 212 is activated when the positive voltage setting signal S20 comes into a PWM signal state and when the positive voltage on/off signal S21 becomes the power supply voltage Vdd (5 V). The control circuit 212 receives the positive voltage setting signal S20, generates an output signal S22 serving as a voltage for turning on an npn transistor Tr3, which is a switch element of the driving circuit 213, and outputs the output signal S22.

Driving Circuit 213

The driving circuit 213 includes the npn transistor Tr3.

A base terminal of the npn transistor Tr3 is connected to the control circuit 212 and the transformer 214. An emitter terminal of the npn transistor Tr3 is grounded (ground voltage GND), and a collector terminal thereof is connected to the transformer 214.

Transformer 214

The transformer 214 includes a primary winding T1*b*, a primary auxiliary winding T1*c*, and a secondary winding T2*b*. The power supply voltage Vcc is supplied to one terminal of the primary winding T1*b*. The other terminal of the primary winding T1*b* is connected to the collector terminal of the npn transistor Tr3 of the driving circuit 213.

One terminal of the primary auxiliary winding T1*c* is connected to the base terminal of the npn transistor Tr3. The other terminal of the primary auxiliary winding T1*c* is grounded (ground voltage GND).

The secondary winding T2*b* is connected to the rectifier circuit 215.

Rectifier Circuit 215

The rectifier circuit 215 rectifies a current induced at the secondary winding Tb2 of the transformer 214, and generates a cleaning bias of a positive voltage.

The rectifier circuit 215 includes a diode D4, a capacitor C4, and a resistor R9.

An anode terminal of the diode D4 is connected to one terminal of the secondary winding Tb2. A cathode terminal of the diode D4 is connected to one terminals of the capacitor C4 and the resistor R9 which are connected in parallel. The other terminals of the capacitor C4 and the resistor R9 which are connected in parallel are connected to the other terminal of the secondary winding Tb2.

Here, the diode D4 has a configuration similar to that of the diode D2 in the rectifier circuit 205 of the negative voltage generating unit 200. However, the direction in which current flows therethrough is opposite. Accordingly, a positive voltage is generated.

The one terminals of the capacitor C4 and the resistor R9 which are connected in parallel are connected to the other terminals of the capacitor C2 and the resistor R4 which are connected in parallel in the rectifier circuit 205 of the negative voltage generating unit 200.

The other terminals of the capacitor C4 and the resistor R9 which are connected in parallel are connected to a negative input terminal of the error amplifier Amp3 of the current detecting circuit 230, which will be described below.

Now, the operation of the self-excited positive voltage generating unit 210 will be described.

When a positive voltage (output signal S22) which exceeds an Si built-in potential (0.6 V) is input to the base terminal of the npn transistor Tr3 of the driving circuit 213 from the control circuit 212, the npn transistor Tr3 is turned on. Then, a current flows between the power supply voltage Vcc (24 V) and the ground voltage GND (0 V) via the primary winding Tb1 and the npn transistor Tr3.

The flow of the current through the primary winding T1*b* of the transformer 214 causes a voltage to be generated at the primary auxiliary winding T1*c*. The generated voltage causes the voltage at the base terminal to increase. Accordingly, a corrector current of the npn transistor Tr3 increases over time.

At this time, a voltage is generated also at the secondary winding T2*b*. However, the direction of this voltage is opposite to the direction of the current which flows through the diode D4. Thus, no currents flow through the secondary winding T2*b*.

The amplification factor of the npn transistor Tr3 is limited, and thus the magnitude of the collector current does not increase after reaching a certain value, and a change in the magnetic flux of the core of the primary winding T1*b* stops. Then, a force to maintain the present current direction acts on the primary winding T1*b*, and a voltage in the opposite direction is generated. Accordingly, a voltage whose direction is the same as the current which flows through the diode D4 is generated at the secondary winding T2*b*, and a current flows through the secondary winding T2*b*.

The voltage in the opposite direction generated at the primary winding Tb1 causes a voltage in the opposite direction to be generated at the primary auxiliary winding Tc1, and the base-emitter voltage of the npn transistor Tr3 is reversely biased. Accordingly, the npn transistor Tr3 is turned off.

When the current which flows through the diode D4 becomes zero, the voltages generated at the primary winding T1*b*, the primary auxiliary winding T1*c*, and the secondary winding T2*b* become 0 V. Accordingly, the base-emitter voltage of the npn transistor Tr3 increases again due to the positive voltage (output signal S22) from the control circuit 212, and the npn transistor Tr3 is turned on again.

As a result of switching (on/off) the npn transistor Tr3 in this way, a current which flows through the secondary winding T2*b* in an off-period causes a cleaning bias of a positive voltage to be generated.

The cleaning bias is controlled by the positive voltage (output signal S22) output from the control circuit 212. That is, as the value of the positive voltage output from the control circuit 212 increases, the magnitude of the current which flows through the npn transistor Tr3 increases, and the cleaning bias increases. In contrast, as the value of the positive voltage output from the control circuit 212 decreases, the magnitude of the current which flows through the npn transistor Tr3 decreases, and the cleaning bias decreases.

The positive voltage output from the control circuit 212 is set in accordance with the duty ratio of the positive voltage setting signal S20. As the duty ratio of the positive voltage setting signal S20 increases, the positive voltage output from the control circuit 212 increases.

Next, the threshold setting circuit 220, the current detecting circuit 230, and the output control circuit 240 will be described.

Threshold Setting Circuit 220

The threshold setting circuit 220 sets a threshold voltage Vth1, which is an example of a first threshold corresponding to a limit current Ip1, which is an example of a first limit value, and a threshold voltage Vth2, which is an example of a second threshold corresponding to a limit current Ip2, which is an example of a second limit value, so that the limit current Ip1 and the limit current Ip2 are set for the output current Iout. The limit currents Ip1 and Ip2 are referred to as limit currents Ip when they are not distinguished from each other, and the threshold voltages Vth1 and Vth2 are referred to as threshold voltages Vth when they are not distinguished from each other. It is assumed that the limit current Ip2 is larger than the limit current Ip1 (Ip2>Ip1), and the threshold voltage Vth2 is smaller than the threshold voltage Vth1 (Vth2<Vth1).

At the switching from a cleaning bias of a positive voltage to a transfer bias of a negative voltage, the threshold voltage Vth is changed to the smaller threshold voltage Vth2, and the limit current Ip is changed to the larger limit current Ip2.

In this specification, the output current Iout and the limit currents Ip1 and Ip2 are absolute values.

The threshold setting circuit 220 includes a comparator Cmp2, an npn transistor Tr4, resistors R10, R11, R12, R13, R14, R15, R16, R17, R18, and R19, a capacitor C5, and the diode D5. The resistor R14 is a variable resistor whose value is variable.

The power supply voltage Vdd is supplied to one terminal of the resistor R10. The other terminal of the resistor R10 is connected to an anode terminal of the diode D5. A cathode terminal of the diode D5 is connected to the collector terminal (voltage Va) of the npn transistor Tr2 of the positive voltage on/off circuit 211 of the positive voltage generating unit 210.

One terminal of the capacitor C5 is connected to a connection point between the resistor R10 and the diode D5. The other terminal of the capacitor C5 is connected to a positive input terminal of the comparator Cmp2 via the resistor R11. Also, the positive input terminal of the comparator Cmp2 is connected to one terminal of the resistor R12. The other terminal of the resistor R12 is grounded (ground voltage GND). The capacitor C5 and the resistors R11 and R12 constitute a differentiation circuit.

The resistors R13 and R14 are connected in series. The power supply voltage Vdd is supplied to the terminal of the resistor R13 which is not connected to the resistor R14. On the other hand, the terminal of the resistor R14 which is not connected to the resistor R13 is grounded (ground voltage GND). A connection point between the resistors R13 and R14 is connected to a negative input terminal of the comparator Cmp2.

An output terminal of the comparator Cmp2 is connected to a base terminal of the npn transistor Tr4 via the resistor R15. The base terminal of the npn transistor Tr4 is grounded (ground voltage GND) via the resistor R16.

An emitter terminal of the npn transistor Tr4 is grounded (ground voltage GND).

The resistors R17, R18, and R19 are connected in series in this order. The power supply voltage Vdd is supplied to the terminal of the resistor R17 which is not connected to the resistor R18. The terminal of the resistor R19 which is not connected to the resistor R18 is grounded (ground voltage GND).

A connection point between the resistors R18 and R19 is connected to a collector terminal of the npn transistor Tr4.

A connection point between the resistors R17 and R18 is connected to the output control circuit 240, so as to output an output signal S23 to the output control circuit 240.

Here, the voltage at the positive input terminal of the comparator Cmp2 is referred to as a voltage Vb, the voltage at the negative input terminal of the comparator Cmp2 is referred to as a reference voltage Vr, and the voltage at the output terminal of the comparator Cmp2 is referred to as a voltage Vc. The voltage Vc may be the voltage at the base terminal of the npn transistor Tr4.

The threshold setting circuit 220 is activated when the positive voltage setting signal S20 is changed from the PWM signal state to the "L" state when the transfer bias power supply 27 performs switching from a cleaning bias of a positive voltage to a transfer bias of a negative voltage.

That is, at the time when the positive voltage setting signal S20 is changed from the PWM signal state to the "L" state (time b in FIG. 4, which will be described below), the voltage Va at the collector terminal of the npn transistor Tr2 changes to the power supply voltage Vdd. Since the capacitor C5 and the resistors R11 and R12 constitute a differentiation circuit, the voltage Vb at the positive input terminal of the comparator Cmp2 changes to the power supply voltage Vdd. At this time, if the reference voltage Vr at the negative input terminal of the comparator Cmp2 is lower than the power supply voltage Vdd, the voltage Vc at the output terminal of the comparator Cmp2 becomes the power supply voltage Vdd. Accordingly, the voltage at the base terminal of the npn transistor Tr4 becomes the power supply voltage Vdd, and the npn transistor Tr4 is turned on. Then, among the resistors R17, R18, and R19 connected in series, the resistor R19 is short-circuited. That is, the output signal S23 is the threshold voltage Vth2, which corresponds to a voltage obtained by dividing the power supply voltage Vdd by the resistors S17 and R18 (=Vdd×R18/(R17+R18)).

Subsequently, the voltage Vb at the positive input terminal of the comparator Cmp2 gradually decreases due to the differentiation circuit (the capacitor C5 and the resistors R11 and R12). When the voltage Vb becomes lower than the reference voltage Vr, the output of the comparator Cmp2 changes to the ground voltage GND (0 V). Accordingly, the npn transistor Tr4 is turned off. Then, the output signal S23 becomes the threshold voltage Vth1, which corresponds to a voltage obtained by dividing the power supply voltage Vdd by the resistors S17, R18, and R19 (=Vdd×(R18+R19)/(R17+R18+R19)). That is, the threshold voltage Vth1 is higher than the threshold voltage Vth2.

The timing of a change from the threshold voltage Vth2 to the threshold voltage Vth1 is set by the differentiation circuit constituted by the capacitor C5 and the resistors R11 and R12.

The reference voltage Vr at the negative input terminal of the comparator Cmp2 may be adjusted by the value of the resistor R14, which is a variable resistor. That is, when the positive voltage setting signal S20 changes from the PWM signal state to the "L" state, the voltage Va at the collector terminal of the npn transistor Tr2 changes to the power supply voltage Vdd. Also, the voltage Vb at the positive input terminal of the comparator Cmp2 changes to the power supply voltage Vdd. Thus, when the reference voltage Vr is variable, the voltage Vb for changing the threshold voltage Vth may be set. Accordingly, the threshold voltage Vth may be changed before supply of a transfer bias of a negative voltage starts.

That is, in the threshold setting circuit 220, the output signal S23 is the threshold voltage Vth2 in a period determined by the capacitor C5 and the resistors R11 and R12, which constitute a differentiation circuit, from the time (timing) when the voltage Va at the collector terminal of the npn transistor Tr2 changes to the power supply voltage Vdd. In the other period, the output signal S23 is the threshold voltage Vth1.

Current Detecting Circuit 230

The current detecting circuit 230 detects the output current Iout.

The current detecting circuit 230 includes the error amplifier Amp3 and resistors R20 and R21. The positive input terminal of the error amplifier Amp3 is connected to a connection point between the resistor R6 of the voltage detecting circuit 206 of the negative voltage generating unit 200 and the reference voltage Vref. The negative input terminal of the error amplifier Amp3 is connected to the other terminals of the capacitor C4 and the resistor R9 connected in parallel of the rectifier circuit 215 of the positive voltage generating unit 210, and is also connected to the output terminal of the error amplifier Amp3 via the resistor R20. The output terminal of the error amplifier Amp3 is connected to one terminal of the resistor R21. The other terminal of the resistor R21 is connected to the output control circuit 240, which will be described below.

The current detecting circuit 230 detects the output current Iout which flows through the resistor R20, and outputs a detection signal S51 of a voltage which is proportional to the output current Iout.

Output Control Circuit 240

The output control circuit 240 performs control so that an overcurrent does not flow through a load, in accordance with the detection signal S51 supplied from the current detecting circuit 230.

The output control circuit 240 includes the error amplifier Amp4 and the diode D6. A positive input terminal of the error amplifier Amp4 is connected to a connection point between the resistors R17 and R18, the connection point serving as an output terminal of the threshold setting circuit 220. A negative input terminal of the error amplifier Amp4 is connected to the other terminal of the resistor R21 of the current detecting circuit 230.

The error amplifier Amp4 compares the detection signal S51 of a voltage which is output from the current detecting circuit 230 and is received by the negative input terminal and which is proportional to the output current Iout, with the output signal S23 (the threshold voltage Vth (the threshold voltage Vth1 or Vth2)) which is output from the threshold setting circuit 220 and which is received by the positive input terminal, amplifies the difference therebetween, and outputs the amplified difference as the output signal S24.

The cathode terminals of the diodes D1 and D6 are connected to the negative input terminal of the comparator Cmp1. Thus, the negative input terminal of the comparator Cmp1 of the control circuit 202 receives a signal having a higher voltage among the output signal S24 and the output signal S12 of the error amplifier Amp1 of the control circuit 202.

The circuit configuration of the transfer bias power supply 27 illustrated in FIG. 3 is an example. FIG. 3 illustrates an equivalent circuit of components, such as transistors, resistors, capacitors, and transformers. The transfer bias power supply 27 may have another circuit configuration and may include other circuits and components.

The configuration of the control circuit 202 of the negative voltage generating unit 200 may be modified as long as it is capable of switching (on/off) the field-effect transistor FET. Thus, the control circuit 202 may have another configuration and may include other circuits. Also, the control circuit 202 may be configured as an integrated circuit (IC) which controls a switching power supply for generating a DC or AC voltage by switching (on/off) a switch element (in the present exemplary embodiment, the field-effect transistor FET). The IC may include the output control circuit 240 and other circuits.

In FIG. 3, the positive voltage generating unit 210 is a self-excited switching power supply. Alternatively, the positive voltage generating unit 210 may be a separately excited switching power supply, like the negative voltage generating unit 200.

Operation of Transfer Bias Power Supply 27

Next, the operation of the transfer bias power supply 27 will be described.

Figure 4:
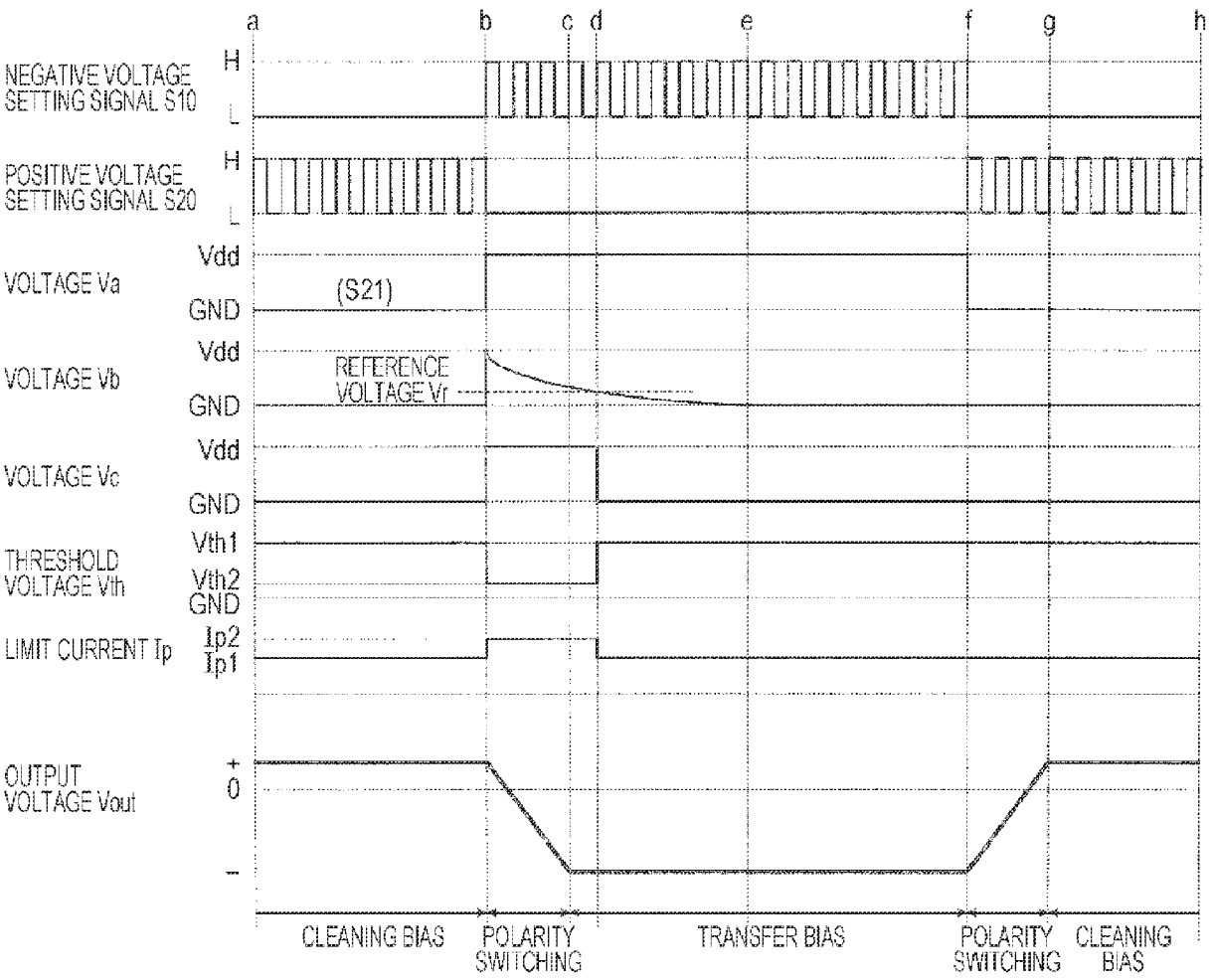
FIG. 4 is a timing chart describing an example of an operation of the transfer bias power supply.

FIG. 4 is a timing chart describing an example of the operation of the transfer bias power supply 27. FIG. 4 illustrates the negative voltage setting signal S10, the positive voltage setting signal S20, the voltage Va at the collector terminal of the npn transistor Tr2 of the positive voltage on/off circuit 211 of the positive voltage generating unit 210, the voltage Vb at the positive input terminal of the comparator Cmp2 of the threshold setting circuit 220, the voltage Vc at the output terminal of the comparator Cmp2, the threshold voltage Vth (output signal S23) which is set by the threshold setting circuit 220, the limit current Ip corresponding to the threshold voltage Vth, and the output voltage Vout.

The time elapses in alphabetical order (a, b, c, . . . ).

At time "a", the output voltage Vout of the transfer bias power supply 27 is a cleaning bias of a positive voltage. At this time, the positive voltage setting signal S20 is in the PWM signal state. In FIG. 4, it is assumed that the PWM signal has a duty ratio of 50%.

The negative voltage setting signal S10 is in the "L" state.

In the positive voltage on/off circuit 211 of the positive voltage generating unit 210, a voltage generated by smoothing a PWM signal is applied to the base terminal of the npn transistor Tr2. Then, the npn transistor Tr2 is turned on, and the voltage Va at the collector terminal becomes the ground voltage GND (0 V).

Accordingly, the positive voltage on/off signal S21 becomes the ground voltage GND (0 V), and a cleaning bias of a positive voltage is output from the positive voltage generating unit 210 as the output voltage Vout (in FIG. 4, voltage drop caused by a forward bias of the diode D3 is not considered). The magnitude of the cleaning bias is determined in accordance with the duty ratio of the positive voltage setting signal S20, as described above.

At this time, the voltage Vb at the positive input terminal of the comparator Cmp2 of the threshold setting circuit 220 is the ground voltage GND (0 V), as described below. Thus, the voltage Vb at the positive input terminal of the comparator Cmp2 is lower than the reference voltage Vr at the negative input terminal (for example, 2 V between the ground voltage GND (0 V) and the power supply voltage Vdd (5 V)), and thus the voltage Vc at the output terminal of the comparator Cmp2 is the ground voltage GND (0 V). Thus, the npn transistor Tr4 is in an off-state, and the threshold voltage Vth is the threshold voltage Vth1.

In accordance with the threshold voltage Vth1, the limit current Ip is the limit current Ip1. That is, the output control circuit 240 sets the output signal S24 so that, when the output current Iout is larger than or equal to the limit current Ip1, the output voltage Vout becomes lower than in a case where the output current Iout is smaller than the limit current Ip1.

At time "b", switching from a cleaning bias of a positive voltage to a transfer bias of a negative voltage starts. That is, the positive voltage setting signal S20 is changed from the PWM signal state to the "L" state. The negative voltage setting signal S10 is changed from the "L" state to the PWM signal state.

Then, the voltage at the base terminal of the npn transistor Tr2 of the positive voltage on/off circuit 211 of the positive voltage generating unit 210 changes to the ground voltage GND (0 V), and thus the npn transistor Tr2 is turned off. Accordingly, the voltage Va at the collector terminal of the npn transistor Tr2 becomes the power supply voltage Vdd (5 V). Accordingly, the voltage Vb at the positive input terminal of the comparator Cmp2 changes from the ground voltage GND (0 V) to the power supply voltage Vdd (5 V).

Because of the differentiation circuit constituted by the capacitor C5 and the resistors R11 and R12, the voltage Vb at the positive input terminal of the comparator Cmp2 increases to the power supply voltage Vdd (5 V), and then decreases toward the ground voltage GND (0 V) over time.

At time "b", the voltage Vb at the positive input terminal of the comparator Cmp2 (power supply voltage Vdd (5 V)) is higher than the reference voltage Vr (2 V), and thus the voltage Vc at the output terminal of the comparator Cmp2 is the power supply voltage Vdd (5 V). Then, the npn transistor Tr4 is turned on, and the threshold voltage Vth is changed from the threshold voltage Vth1 to the threshold voltage Vth2, which is smaller than the threshold voltage Vth1.

In accordance with the change of the threshold voltage Vth, the limit current Ip is changed from the limit current Ip1 to the limit current Ip2, which is larger than the limit current Ip1. That is, the output control circuit 240 sets the output signal S24 so that, when the output current Iout is larger than or equal to the limit current Ip2, the output voltage Vout becomes lower than in a case where the output current Iout is smaller than the limit current Ip2.

In the present exemplary embodiment, it is assumed that the limit current Ip2 is larger than the limit current Ip1 (Ip2>Ip1). Thus, the limit current Ip is increased at the switching from a cleaning bias of a positive voltage to a transfer bias of a negative voltage.

At time "c", the output voltage Vout becomes a transfer bias of a negative voltage. At this time, the limit current Ip2 is maintained.

In this way, a period of polarity switching (the period from time "b" to time "c") is necessary for the output voltage Vout when switching from a cleaning bias to a transfer bias is performed.

At time "d", the voltage Vb at the positive input terminal of the comparator Cmp2 becomes lower than the reference voltage Vr (2 V). Then, the voltage Vc at the output terminal of the comparator Cmp2 changes from the power supply voltage Vdd (5 V) to the ground voltage GND (0 V).

Accordingly, the npn transistor Tr4 is turned off, and the threshold voltage Vth changes to the threshold voltage Vth1. Accordingly, the limit current Ip changes to the limit current Ip1.

At time "e", the voltage Vb at the positive input terminal of the comparator Cmp2 further decreases to become the ground voltage GND (0 V).

At time "f", switching from a transfer bias of a negative voltage to a cleaning bias of a positive voltage starts. That is, the negative voltage setting signal S10 is changed from the PWM signal state to the "L" state. The positive voltage setting signal S20 is changed from the "L" state to the PWM signal state.

Then, in the positive voltage on/off circuit 211 of the positive voltage generating unit 210, a voltage generated by smoothing a PWM signal is applied to the base terminal of the npn transistor Tr2, and the npn transistor Tr2 is turned on. Accordingly, the voltage Va at the collector terminal of the npn transistor Tr2 becomes the ground voltage GND (0 V).

At this time, the voltage Vb at the positive input terminal of the comparator Cmp2 is already the ground voltage GND (0 V), and thus the ground voltage GND (0 V) is maintained.

Thus, the voltage Vc at the output terminal of the comparator Cmp2 is maintained at the ground voltage GND (0 V), and the npn transistor Tr4 is in an off-state. Thus, the threshold voltage Vth1 and the limit current Ip1 are maintained.

At time "g", the output voltage Vout becomes a cleaning bias of a positive voltage.

After that, the above-described operation performed at time "a" and thereafter is repeated.

In FIG. 4, at time "b", the positive voltage setting signal S20 is changed from the PWM signal state to the "L" state, and the negative voltage setting signal S10 is changed from the "L" state to the PWM signal state. The negative voltage setting signal S10 may be changed from the "L" state to the PWM signal state after a predetermined period has elapsed from the change of the positive voltage setting signal S20 from the PWM signal state to the "L" state. In this way, as the output voltage Vout, supply of a negative voltage is started after supply of a positive voltage has stopped.

Alternatively, the negative voltage setting signal S10 may be changed from the "L" state to the PWM signal state a predetermined time before the positive voltage setting signal S20 is changed from the PWM signal state to the "L" state. Accordingly, the period until supply of a negative voltage starts may be shortened.

The same applies to time "f".

Figure 5:
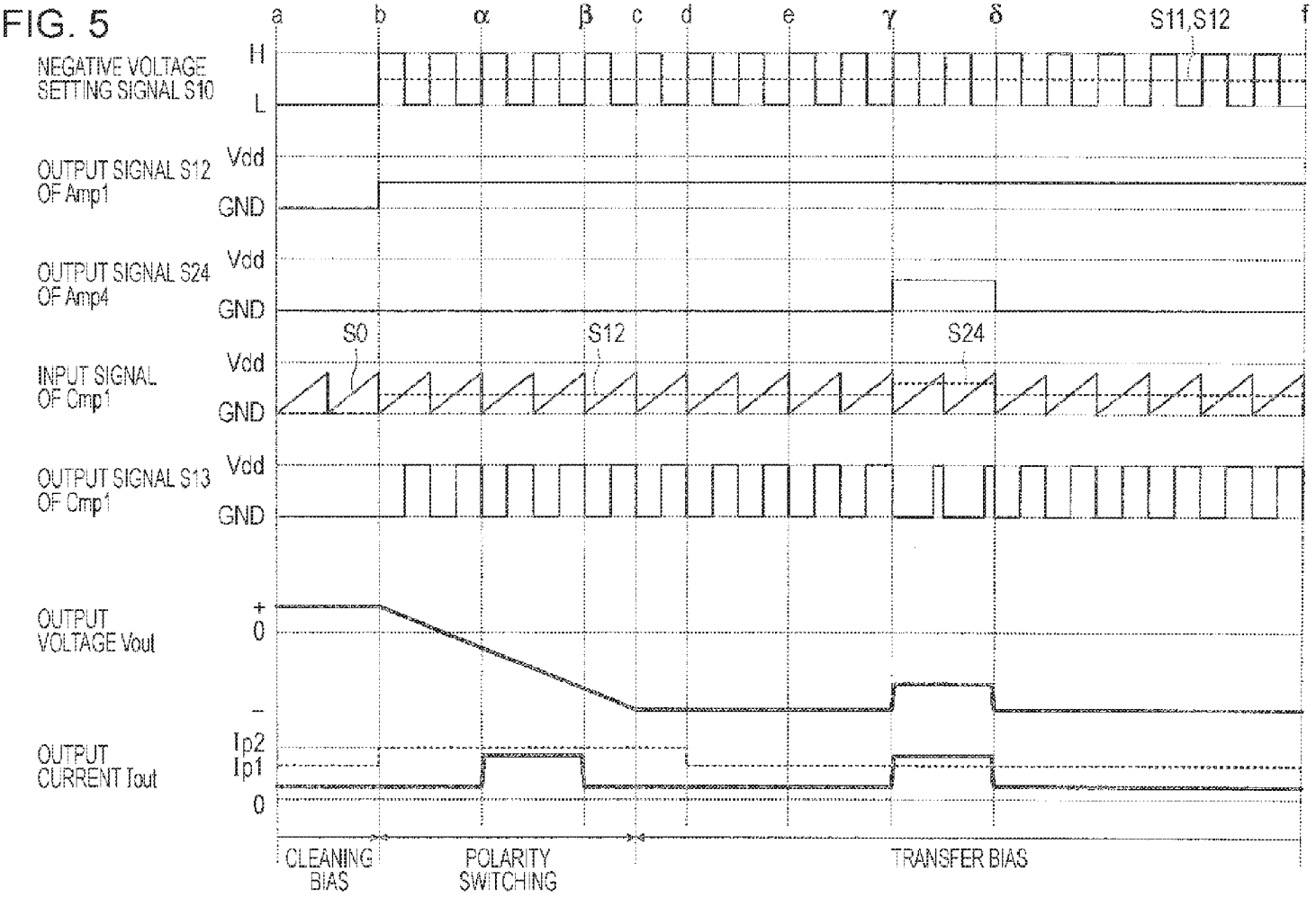
FIG. 5 is a timing chart describing an example of controlling an output voltage Vout by using an output current Iout.

FIG. 5 is a timing chart illustrating an example of control of the output voltage Vout using the output current Iout.

FIG. 5 illustrates the negative voltage setting signal S10, the output signal S12 of the error amplifier Amp1 of the control circuit 202 of the negative voltage generating unit 200, the output signal S24 of the error amplifier Amp4 of the output control circuit 240, the input signal of the comparator Cmp1 of the control circuit 202, the output signal S13 of the comparator Cmp1, the output voltage Vout, and the output current Iout. The input signal of the comparator Cmp1 of the control circuit 202 corresponds to the triangular-wave signal S0 of the oscillator OSC, and a signal having a higher voltage among the output signal S12 of the error amplifier Amp1 and the output signal S24 of the error amplifier Amp4.

Regarding the output current Iout, the limit currents Ip1 and Ip2 are shown with a broke line.

It is assumed that the triangular-wave signal S0 is output at any time.

The symbols representing times are the same as those in FIG. 4. FIG. 5 illustrates a period from time "a" to time "f". In addition, time "α" and time "β" are set between time "b" and time "c", and time "γ" and time "δ" are set between time "e" and time "f".

At time "a", as in FIG. 4, the output voltage Vout of the transfer bias power supply 27 is a cleaning bias of a positive voltage. That is, at time "a", the negative voltage setting signal S10 is in the "L" state, and the output signal S12 of the error amplifier Amp1 of the control circuit 202 is the ground voltage GND (0 V). The limit current Ip is set to the limit current Ip1.

At time "b", switching from a cleaning bias of a positive voltage to a transfer bias of a negative voltage starts. That is, the positive voltage setting signal S20 is changed from the PWM signal state to the "L" state (not illustrated in FIG. 5). Also, the negative voltage setting signal S10 is changed from the "L" state to the PWM signal state.

Then, the PWM signal is smoothed by the analog conversion circuit 201 of the negative voltage generating unit 200, so that the analog signal S11 of a DC voltage is generated. Here, an influence of the voltage detecting circuit 206 is not considered. Thus, it is assumed that the output signal S12 of the error amplifier Amp1 of the control circuit 202 is the analog signal S11.

That is, the output signal S12 of the error amplifier Amp1 is a DC voltage generated by smoothing the PWM signal of the negative voltage setting signal S10.

As described above, at time "b", the limit current Ip is changed to the limit current Ip2, which is larger than the limit current Ip1.

At time "b", if it is assumed that the output current Iout is smaller than the limit current Ip2, the output signal S24 of the error amplifier Amp4 is set to be smaller than the output signal S12 of the error amplifier Amp1, and thus the output signal S12 of the error amplifier Amp1 is input to the negative input terminal of the comparator Cmp1.

Thus, from time "b" to time "α", the output signal S13 of the comparator Cmp1 is a PWM signal which is determined based on the triangular-wave signal S0 and the output signal S12 of the error amplifier Amp1, as illustrated in FIG. 5.

It is assumed that, in accordance with the switching from a cleaning bias of a positive voltage to a transfer bias of a negative voltage, the output current Iout becomes a rush current which is larger than or equal to the limit current Ip1 and is smaller than the limit current Ip2 at time "α". This current continuously flows till time "β".

However, since the limit current Ip is set to the limit current Ip2, the output signal S24 of the error amplifier Amp4 is smaller than the output signal S12 of the error amplifier Amp1. Thus, the output signal S12 of the error amplifier Amp1 is input to the negative input terminal of the comparator Cmp1.

That is, the output signal S13 of the comparator Cmp1 is a PWM signal in the period from time "α" to time "d", as in the period from time "b" to time "α". That is, the output voltage Vout is not affected by the rush current which flows in the period from time "α" to time "P".

At time "c", the output voltage Vout becomes a transfer bias of a negative voltage. At this time, the limit current Ip2 is maintained.

At time "d", the threshold setting circuit 220 changes the threshold voltage Vth from the threshold voltage Vth2 to the threshold voltage Vth1, and the limit current Ip is changed from the limit current Ip2 to the limit current Ip1.

At time "e", the voltage Vb at the negative input terminal of the comparator Cmp2 becomes the ground voltage GND (0 V) (see FIG. 4).

At time "γ", the output current Iout becomes larger than or equal to the limit current Ip1 and is smaller than the limit current Ip2. Then, the current detecting circuit 230 outputs the detection signal S51 of a voltage which is proportional to this current. Then, the output control circuit 240 outputs the output signal S24, which is generated by amplifying the difference between the threshold voltage Vth1 and the detection signal S51. At this time, the voltage of the output signal S24 is set to be higher than the voltage of the output signal S12 of the error amplifier Amp1.

Accordingly, the negative input terminal of the comparator Cmp1 receives the output signal S24 of the error amplifier Amp4. Since the voltage of the output signal S24 is higher than the voltage of the output signal S12, the duty ratio of the output signal S13, which is a PWM signal of the comparator Cmp1, becomes lower than that in the period from time "b" to time "γ". Thus, the absolute value of the output voltage Vout becomes small.

At time "δ", the output current Iout becomes smaller than the limit current Ip1, and the voltage of the output signal S24 of the error amplifier Amp4 becomes lower than the voltage of the output signal S12 of the error amplifier Amp1. Accordingly, the negative input terminal of the comparator Cmp1 receives the output signal S12 of the error amplifier Amp1.

Then, the duty ratio of the output signal S13, which is a PWM signal of the comparator Cmp1, becomes the same as that in the period from time "b" to time "γ". Accordingly, the value of the output voltage Vout becomes the same as that in the period from time "c" to time "γ".

As described above, in the present exemplary embodiment, at the switching from a cleaning bias of a positive voltage to a transfer bias of a negative voltage, the threshold Vth is changed from the threshold voltage Vth1 to the threshold voltage Vth2, whereby the limit current Ip is changed from the limit current Ip1 to the limit current Ip2 (Ip1<Ip2). After the switching to a transfer bias of a negative voltage has finished (after time "c"), the limit current Ip is changed from the limit current Ip2 to the limit current Ip1.

In this way, even if a rush current which is larger than or equal to the limit current Ip1 flows in the period of polarity switching (from time "b" to time "c"), if the rush current is smaller than the limit current Ip2, the output control circuit 240 is not operated and the absolute value of the output voltage Vout does not decrease.

On the other hand, if the limit current Ip is kept at the limit current Ip1, the output control circuit 240 is operated if a rush current which is larger than or equal to the limit current Ip1 and is smaller than the limit current Ip2 flows in the period of polarity switching (from time "b" to time "c"). Accordingly, the control circuit 202 performs control to decrease the absolute value of the output voltage Vout, which causes delay of rise of a transfer bias of a negative voltage.

That is, in the present exemplary embodiment, delay of rise of a transfer bias of a negative voltage is suppressed.

Furthermore, in the present exemplary embodiment, after switching to a transfer bias of a negative voltage ends (at time "d"), the limit current Ip is changed from the limit current Ip2 to the limit current Ip1.

Thus, if the output current Iout becomes larger than or equal to the limit current Ip1 while a transfer bias of a negative voltage is being supplied after time "d", the output control circuit 240 is operated to decrease the absolute value of the output voltage Vout, and thus the output current Iout is suppressed. That is, the current (output current Iout) which flows through the second transfer section 20 constituted by the power feed roller 26, the backup roller 25, the intermediate transfer belt 15, the sheet P, the second transfer roller 22, and so forth is suppressed. Accordingly, an increase in temperature in the second transfer section 20 is suppressed, and heating or firing of a member made of plastic or the like and the sheet P around the second transfer section 20 is suppressed.

Furthermore, in the present exemplary embodiment, the time at which the limit current Ip is changed from the limit current Ip1 to the limit current Ip2 (time "b" in FIGS. 4 and 5) is set by the positive voltage setting signal S20. That is, time "b" is set by detecting, with the threshold setting circuit 220, a change of the positive voltage setting signal S20 from the PWM signal state to the "L" state. That is, the limit current Ip is changed by detecting that supply of a cleaning bias is stopped. Thus, a control circuit or/and a control signal for changing the limit current Ip is not necessary, and the limit current Ip may be changed in accordance with stop of a cleaning bias. Accordingly, delay of change of the limit current Ip is suppressed.

Furthermore, the time at which the limit current Ip is changed from the limit current Ip2 to the limit current Ip1 (time "d" in FIGS. 4 and 5) is set by the differentiation circuit constituted by the capacitor C5 and the resistors R11 and R12. Thus, a control circuit or/and a control signal for changing the limit current Ip from the limit current Ip2 to the limit current Ip1 is not necessary.

Example

Hereinafter, an example will be described.

Figure 6A:
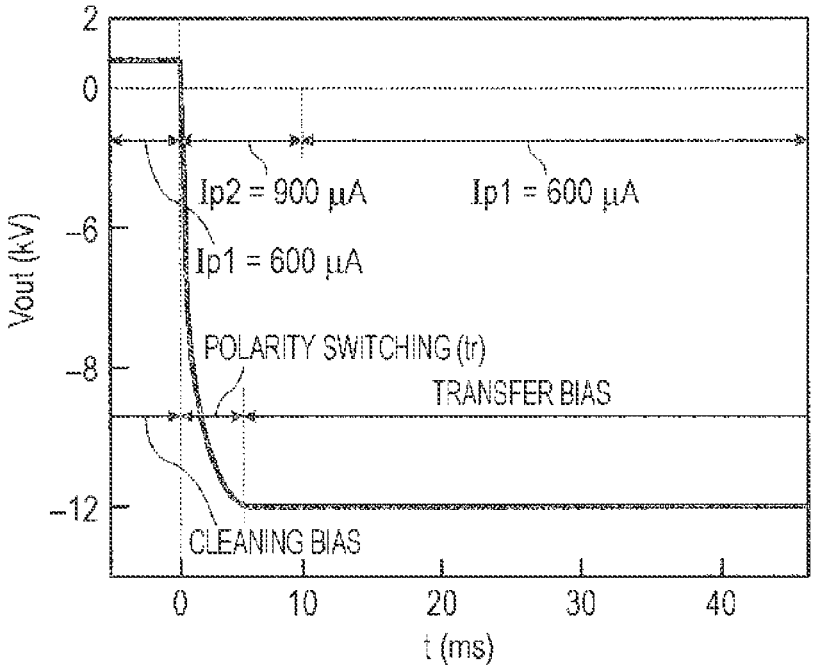
FIGS. 6A and 6B are diagrams illustrating an example and a comparative example.
Figure 6B:
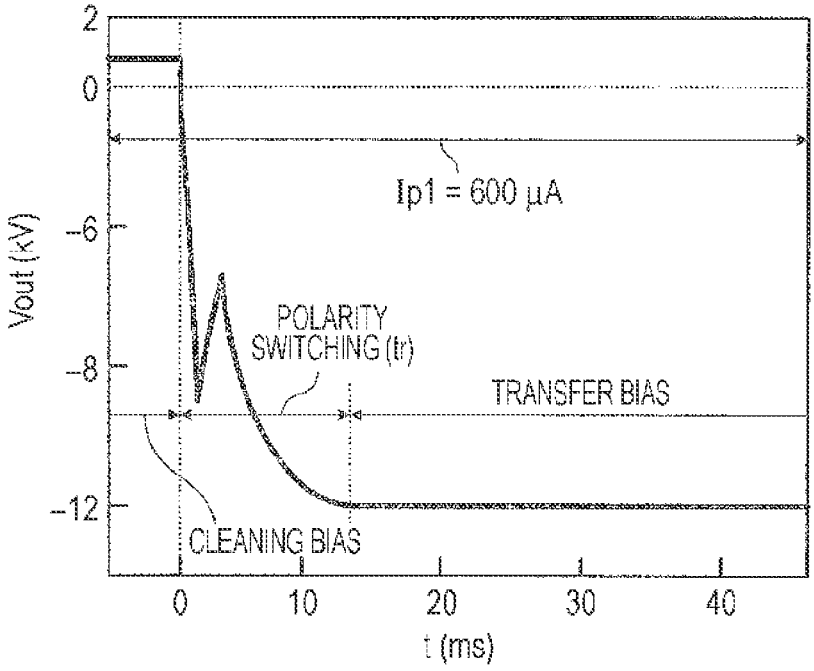

FIG. 6A is a diagram illustrating an example, and 6B is a diagram illustrating a comparative example. FIGS. 6A and 6B illustrate an output voltage Vout (kV) in a case where switching from a cleaning bias to a transfer bias is performed. The cleaning bias is 0.7 kV, and the transfer bias is −12 kV. The horizontal axis indicates time t (ms). The switching starts when time t (ms) is "0" (t=0 ms). This corresponds to time "b" in FIGS. 4 and 5.

In the example according to the present exemplary embodiment illustrated in FIG. 6A, the limit current Ip is changed from 600 μA (limit current Ip1) to 900 μA (limit current Ip2) at the switching starting time (t=0 ms). For a period of 10 ms from the switching starting time (t=0 ms), the limit current Ip is maintained at 900 μA (limit current Ip2), and then the limit current Ip is changed to 600 μA (limit current Ip1).

On the other hand, in the comparative example illustrated in FIG. 6B, in which the present exemplary embodiment is not used, the limit current Ip is maintained at 600 μA (limit current Ip1) from the switching starting time (t=0 ms).

In the example illustrated in FIG. 6A, switching from the cleaning bias of 0.7 kV to the transfer bias of −12 kV is smoothly performed. The rising time tr from the switching starting time (t=0 ms) to the time when the transfer bias of −12 kV starts being supplied is 5 ms.

On the other hand, in the comparative example illustrated in FIG. 6B in which the present exemplary embodiment is not used, the output voltage Vout (absolute value) sharply decreases at t=1.4 ms, and increases again at t=3.3 ms.

This is because, at t=1.4 ms, the current detecting circuit 230 detects the output current Iout which is larger than or equal to the limit current Ip1 (600 μA), the output control circuit 240 is operated, and the control circuit 202 decreases the output voltage Vout.

Thus, in the comparative example, the rising time tr from the switching starting time (t=0 ms) to the time when the transfer bias of −12 kV starts being supplied is 14 ms.

In the example illustrated here, the rising time tr is 0.36 times.

As described above, in the present exemplary embodiment, switching from a cleaning bias to a transfer bias is smoothly performed, and a rising time which is necessary to reach a predetermined transfer bias is shortened compared to the case of not using the present exemplary embodiment.

In the description given above, in the case of performing switching from a cleaning bias to a transfer bias, the threshold voltage Vth for operating the output control circuit 240 is changed to change the limit current Ip. This is because, as described above regarding the example, the absolute value of the transfer bias (for example, −12 kV) is larger than the absolute value of the cleaning bias (for example, 0.7 kV), and thus a rush current which is generated to start supplying a transfer bias increases.

In the present exemplary embodiment, the positive voltage generating unit 210 is a self-excited switching power supply. However, the positive voltage generating unit 210 may be a separately excited switching power supply, like the negative voltage generating unit 200.

The configuration of the positive voltage generating unit 210 may be similar to that of the negative voltage generating unit 200, and thereby the threshold voltage Vth for activating a protection circuit may be changed to change the limit current Ip in the case of performing switching from a transfer bias to a cleaning bias. Accordingly, activation of the protection circuit caused by a rush current which is generated when supply of a cleaning bias is started is suppressed, and thus the rising time for the cleaning bias is shortened.

Furthermore, in the present exemplary embodiment, the output current Iout is detected by the current detecting circuit 230 while control being performed to decrease the difference between the actual output voltage Vout and a predetermined output voltage Vout, and, when the output current Iout becomes larger than or equal to a predetermined limit current Ip, the absolute value of the output voltage Vout is decreased.

Alternatively, the output voltage Vout may be detected by the voltage detecting circuit 206 while control being performed to decrease the difference between the actual output current Iout and a predetermined output current Iout, and, when the output voltage Vout becomes larger than or equal to a predetermined limit voltage, the output voltage Vout may be decreased so that the absolute value of the output current Iout decreases.

Furthermore, in the present exemplary embodiment, the transfer bias power supply 27 is a power supply that generates a second transfer bias in the second transfer section 20. Alternatively, the transfer bias power supply 27 may be applied to a power supply that generates a first transfer bias in the first transfer sections 10.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a charging unit that charges the image carrier;

an exposure unit that exposes the image carrier charged by the charging unit to light and that forms an electrostatic latent image on the image carrier;

a developing unit that develops the electrostatic latent image formed on the image carrier exposed by the exposure unit, so as to form a developed image; and a transfer unit that includes a bias power supply and that transfers the developed image onto a transfer body, the bias power supply including a first power supply unit, a second power supply unit, a threshold setting unit, a detector, and an output controller, the first power supply unit generating a transfer electric field for transferring the developed image onto the transfer body, the second power supply unit generating a non-transfer electric field having a polarity which is different from a polarity of the transfer electric field, the threshold setting unit having a first upper limit threshold and a second upper limit threshold, the first upper limit threshold corresponding to a first limit value for a current which is caused to flow by the first power supply unit, the second upper limit threshold corresponding to a second limit value which is larger than the first limit value in terms of an absolute value, the threshold setting unit performing a change from the first upper limit threshold to the second upper limit threshold when switching from the non-transfer electric field to the transfer electric field is performed, the detector detecting the current which is caused to flow by the first power supply unit, and the output controller controlling the first power supply unit so that a voltage output from the first power supply unit decreases in terms of an absolute value, when the current which is caused to flow by the first power supply unit becomes larger than or equal to the first limit value or larger than or equal to the second limit value in accordance with the first upper limit threshold or the second upper limit threshold set by the threshold setting unit.

2. A bias power supply device comprising:

a first power supply unit that supplies a first voltage to a load;

a second power supply unit that supplies a second voltage to the load, the second voltage having a polarity which is different from a polarity of the first voltage;

a threshold setting unit that has a first upper limit threshold and a second upper limit threshold, the first upper limit threshold corresponding to a first limit value for the first voltage which is supplied to the load by the first power supply unit or a current which is caused to flow through the load by the first power supply unit, the second upper limit threshold corresponding to a second limit value which is larger than the first limit value in terms of an absolute value, and that performs a change from the first upper limit threshold to the second upper limit threshold when voltage which is supplied to the load is switched from the second voltage to the first voltage;

a detector that detects the first voltage which is supplied to the load by the first power supply unit or the current which is caused to flow through the load by the first power supply unit; and an output controller that controls the first power supply unit so that the first voltage decreases in terms of an absolute value, when the first voltage or the current detected by the detector becomes larger than or equal to the first limit value or larger than or equal to the second limit value in accordance with the first upper limit threshold or the second upper limit threshold set by the threshold setting unit.

3. The bias power supply device according to claim 2, wherein the threshold setting unit performs a change from the second upper limit threshold to the first upper limit threshold at a predetermined time which is after switching from the second voltage to the first voltage has been performed and before switching from the first voltage to the second voltage is performed.

4. The bias power supply device according to claim 3, wherein the threshold setting unit includes a differentiation circuit, and a time at which the change from the second upper limit threshold to the first upper limit threshold is performed is set by the differentiation circuit.

5. The bias power supply device according to claim 2, wherein the threshold setting unit sets a time at which the change from the first upper limit threshold to the second upper limit threshold is performed, in accordance with a signal for setting the second voltage supplied by the second power supply unit.

6. The bias power supply device according to claim 3, wherein the threshold setting unit sets a time at which the change from the first upper limit threshold to the second upper limit threshold is performed, in accordance with a signal for setting the second voltage supplied by the second power supply unit.

7. The bias power supply device according to claim 4, wherein the threshold setting unit sets a time at which the change from the first upper limit threshold to the second upper limit threshold is performed, in accordance with a signal for setting the second voltage supplied by the second power supply unit.

8. The bias power supply device according to claim 2, wherein the first voltage has an absolute value which is larger than an absolute value of the second voltage.

9. The bias power supply device according to claim 3, wherein the first voltage has an absolute value which is larger than an absolute value of the second voltage.

10. The bias power supply device according to claim 4, wherein the first voltage has an absolute value which is larger than an absolute value of the second voltage.

11. The bias power supply device according to claim 5, wherein the first voltage has an absolute value which is larger than an absolute value of the second voltage.

12. The bias power supply device according to claim 6, wherein the first voltage has an absolute value which is larger than an absolute value of the second voltage.

13. The bias power supply device according to claim 7, wherein the first voltage has an absolute value which is larger than an absolute value of the second voltage.

14. A bias power supply method comprising:

supplying a first voltage to a load;

supplying a second voltage to the load, the second voltage having a polarity which is different from a polarity of the first voltage;

providing a first upper limit threshold and a second upper limit threshold, the first upper limit threshold corresponding to a first limit value for the first voltage which is supplied to the load or a current which is caused to flow through the load, the second upper limit threshold corresponding to a second limit value which is larger than the first limit value in terms of an absolute value, and performing a change from the first upper limit threshold to the second upper limit threshold when voltage which is supplied to the load is switched from the second voltage to the first voltage;

detecting the first voltage which is supplied to the load or the current which is caused to flow through the load; and performing control so that the first voltage decreases in terms of an absolute value, when the first voltage or the current detected by the detecting becomes larger than or equal to the first limit value or larger than or equal to the second limit value in accordance with the first upper limit threshold or the second upper limit threshold which is set.

* * * * *